US007987679B2

(12) United States Patent
Tanaka et al.

(10) Patent No.: US 7,987,679 B2
(45) Date of Patent: Aug. 2, 2011

(54) AIR CONDITIONING APPARATUS

(75) Inventors: Kousuke Tanaka, Tokyo (JP); Kouji Yamashita, Tokyo (JP); Yasunori Shida, Tokyo (JP); Masahumi Tomita, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 1007 days.

(21) Appl. No.: 11/547,609

(22) PCT Filed: Feb. 24, 2005

(86) PCT No.: PCT/JP2005/002982

§ 371 (c)(1),
(2), (4) Date: Oct. 4, 2006

(87) PCT Pub. No.: WO2006/090451

PCT Pub. Date: Aug. 31, 2006

(65) Prior Publication Data

US 2007/0204635 A1 Sep. 6, 2007

(51) Int. Cl.
*G01K 13/00* (2006.01)

(52) U.S. Cl. ..... 62/129; 62/125; 62/126; 62/127; 62/160; 62/208; 62/209; 62/225; 62/6

(58) Field of Classification Search ..... 62/127, 62/129, 208, 209, 225, 160, 125, 126, 6
See application file for complete search history.

(56) References Cited

U.S. PATENT DOCUMENTS 4,499,739 A * 2/1985 Matsuoka et al. ..... 62/212

(Continued)

FOREIGN PATENT DOCUMENTS

| | | |
|---|---|---|
| EP | 1 270 292 | 1/2003 |
| JP | 2-110270 A | 4/1990 |
| JP | 03-186170 | 8/1991 |
| JP | 04-148170 | 5/1992 |
| JP | 6-159869 A | 6/1994 |

(Continued)

OTHER PUBLICATIONS

Tassou et al., "Fault Diagnosis and Refrigerant Leak Detection in Vapour Compression Refrigeration Systems" International Journal of Refrigeration, 2005, vol. 28, No. 5, pp. 680-688, XP02578312.

(Continued)

*Primary Examiner* — Frantz F Jules
*Assistant Examiner* — Azim Rahim
(74) *Attorney, Agent, or Firm* — Buchanan Ingersoll & Rooney PC

(57) ABSTRACT

By studying or storing refrigerating cycle characteristics of an air conditioning apparatus at the normal time and comparing them with refrigerating cycle characteristics acquired from the air conditioning apparatus at the time of operation, it becomes possible to exactly and accurately diagnose normality or abnormality of the air conditioning apparatus under any installation conditions and environmental conditions, which eliminates operations of inputting a difference between apparatus model names, a piping length, a height difference, etc at the time of apparatus installation. Accordingly, it aims at shortening the time of judging normality or abnormality, and improving the operability. It is characterized by calculating and comparing a measured value (a value of liquid phase temperature efficiency $\epsilon_L$ ($SC/dT_c$) calculated from temperature information) concerning an amount of a liquid phase part of the refrigerant in the high-pressure-side heat exchanger with a theoretical value (a value of liquid phase temperature efficiency $\epsilon_L$ ($1-EXP(-NTU_R)$) calculated from the transfer unit number $NTU_R$ at refrigerant side).

14 Claims, 8 Drawing Sheets

U.S. PATENT DOCUMENTS

| | | | | |
|---|---|---|---|---|
| 4,835,980 | A * | 6/1989 | Oyanagi et al. | 62/212 |
| 5,214,918 | A | 6/1993 | Oguni et al. | |
| 5,626,026 | A * | 5/1997 | Sumida et al. | 62/129 |
| 5,724,822 | A | 3/1998 | Jonsson et al. | |
| 6,463,747 | B1 | 10/2002 | Temple | |
| 6,571,566 | B1 | 6/2003 | Temple et al. | |
| 7,159,408 | B2 * | 1/2007 | Sadegh et al. | 62/115 |
| 7,685,830 | B2 * | 3/2010 | Thybo et al. | 62/126 |
| 2002/0083723 | A1 | 7/2002 | Demuth et al. | |
| 2003/0019221 | A1 * | 1/2003 | Rossi et al. | 62/127 |
| 2003/0055603 | A1 | 3/2003 | Rossi et al. | |

FOREIGN PATENT DOCUMENTS

| | | | |
|---|---|---|---|
| JP | 7-021374 | A | 1/1995 |
| JP | 07-218058 | | 8/1995 |
| JP | 9-113079 | A | 5/1997 |
| JP | 10-089780 | | 4/1998 |
| JP | 11-083250 | A | 3/1999 |
| JP | 2001-133011 | A | 5/2001 |
| JP | 2003-161535 | A | 6/2003 |
| JP | 2003-322380 | | 11/2003 |
| JP | 2005-257219 | A | 9/2005 |

OTHER PUBLICATIONS

Supplementary European Search Report in corresponding Application No. 05710633.8—1266 dated Mar. 18, 2009.

Y. Shishimo et al., "Compact Heat Exchanger", Nikkan Kogyo Shimbun, Ltd., 1992, pp. 44-45 and 70-73 (with partial English translation).

"Two-Phase Flow Pressure Drop", 4 pages, http://www.energy.kth.se/courses/4a1625/files (and web page of KTH, The Royal Institute of Technology).

International Search Report dated Jun. 14, 2005.

Written Opinion of the International Searching Authority dated Jun. 14, 2005.

Japanese Patent Office dated Jul. 28, 2009, and English-language translation thereof.

* cited by examiner

AIR CONDITIONING APPARATUS

TECHNICAL FIELD

The present invention relates to an air conditioning apparatus that judges normality or abnormality based on operation characteristics detected from the air conditioning apparatus at normal time and operation characteristics at the present.

BACKGROUND ART

With respect to abnormality diagnosis of air conditioning apparatuses, various developments have already been implemented. A fundamental technology of a diagnosis apparatus of an air conditioning apparatus will be described below.

A conventional air conditioning apparatus calculates refrigerating cycle characteristics of the air conditioning apparatus at normal time by performing a cycle simulation based on signals from a temperature sensor and a pressure sensor, which are at the entrance/exit of a compressor, an outside air temperature sensor and an indoor temperature sensor, a model name information on the air conditioning apparatus required for the cycle simulation calculation, and information, inputted through an input part, on an amount of enclosed refrigerant in the air conditioning apparatus, a length of connection piping, and a height difference between an indoor unit and an outdoor unit, and then judges an amount of excess or deficiency of the refrigerant, abnormality of the apparatus, and a blockage in a pipe, etc. at the time of operating the apparatus. (for example, refer to Patent Document 1).

[Patent Document 1] Japanese Unexamined Patent Publication No. 2001-133011

[Non-Patent Document 1] "Compact Heat Exchanger" by Yutaka Seshimo and Masao Fujii, Nikkan Kogyo Shimbun Ltd., (1992)

[Non-Patent Document 2] "Proc. 5th Int. Heat Transfer Conference", by G. P. Gaspari, (1974)

DISCLOSURE OF THE INVENTION

Problems to be Solved by of the Invention

With respect to the above-mentioned conventional structure, model name information on the apparatus, a length difference of the refrigerant piping, and a height difference are needed to be input after installing the apparatus. Therefore, there is a problem that it takes time and effort to check the piping length and the height difference and to input them in the input device each time when installing or performing maintenance of the apparatus.

Moreover, with respect to the conventional air conditioning apparatus, aged deterioration of a fin in an outdoor heat exchanger and an indoor heat exchanger, blockage in a filter, influence of the wind and so forth are not taken into consideration. Therefore, there is a problem that a cause of incorrect detection and abnormality could not be judged correctly.

Moreover, with respect to the conventional air conditioning apparatus, in the case of a model which has equipment for storing surplus refrigerant such as an accumulator and a receiver, being provided as a structure element, if a refrigerant leaks, the surface of a surplus refrigerant in the container just goes down, and the temperature and the pressure of the refrigerating cycle do not change. Therefore, as long as the surplus refrigerant exists, there is a problem that no refrigerant leak could be detected and found at an early stage even if a cycle simulation is performed based on the temperature and pressure information.

Moreover, with respect to a diagnosis apparatus of the conventional air conditioning apparatus, in the case of a model which has equipment for storing surplus refrigerant such as an accumulator and a receiver, being provided as a structure element, since it is necessary to estimate the amount of refrigerant by directly detecting an amount of surplus refrigerant in the container by using a specific detector, such as an ultrasonic sensor in order to detect a refrigerant leak, a problem of the cost occurs.

The present invention aims at solving the above stated problems. By learning or storing refrigerating cycle characteristics of an air conditioning apparatus at normal time and comparing them with refrigerating cycle characteristics obtained from the air conditioning apparatus at the time of operation, it becomes possible to exactly and accurately diagnose normality or abnormality of the air conditioning apparatus under any installation conditions and environmental conditions, which eliminates operations of inputting a difference between apparatus model names, a piping length, a height difference, etc at the time of apparatus installation. Accordingly, it aims at shortening the time of judging normality or abnormality, and improving the operability.

Moreover, by learning or storing refrigerating cycle characteristics of an air conditioning apparatus at normal time and comparing them with refrigerating cycle characteristics obtained from the air conditioning apparatus at the time of operation, it becomes possible to exactly and accurately diagnose normality or abnormality of the air conditioning apparatus under any installation conditions and environmental conditions, which prevents an incorrect detection caused by deterioration of a fin in an outdoor heat exchanger and an indoor heat exchanger, blockage in a filter, and influence of the wind. Accordingly, it aims at providing an air conditioning apparatus with high reliability.

Moreover, by learning or storing refrigerating cycle characteristics of an air conditioning apparatus at normal time and mutually comparing them with refrigerating cycle characteristics obtained from the air conditioning apparatus at the time of operation, it aims at providing an air conditioning apparatus that accurately diagnoses a refrigerant leak in the air conditioning apparatus at an early stage even in the case of a model which has equipment for storing surplus refrigerant such as an accumulator and a receiver, as a structure element.

Moreover, it aims at providing an air conditioning apparatus that accurately diagnoses a refrigerant leak without any additional specific detector, even in the case of a model which has equipment for storing surplus refrigerant such as an accumulator and a receiver.

Moreover, it aims at providing an air conditioning apparatus that accurately diagnoses a leak of refrigerant, regardless of a sort of the refrigerant.

Means to Solve the Problems

It is a feature of the air conditioning apparatus according to the present invention that it includes:

a refrigerating cycle to connect a compressor, a high-pressure-side heat exchanger, a throttle device and a low-pressure-side heat exchanger by piping, to circulate a refrigerant of high temperature and high pressure in the high-pressure-side heat exchanger, and to circulate a refrigerant of low temperature and low pressure in the low-pressure-side heat exchanger;

a fluid sending part to make a fluid circulate outside of the high-pressure-side heat exchanger in order to perform a heat exchange between the refrigerant in the high-pressure-side heat exchanger and the fluid;

a temperature detection part of high-pressure refrigerant to detect a temperature in condensing or in middle of cooling of the refrigerant in the high-pressure-side heat exchanger;

a temperature detection part of high-pressure-side heat exchanger entrance-side refrigerant to detect a temperature of the refrigerant at an entrance side of the high-pressure-side heat exchanger;

a temperature detection part of high-pressure-side heat exchanger exit-side refrigerant to detect a temperature of the refrigerant at an exit side of the high-pressure-side heat exchanger;

a fluid temperature detection part to detect a temperature at a location of the fluid circulating outside of the high-pressure-side heat exchanger;

a temperature detection part of low-pressure refrigerant to detect a temperature in evaporating or in middle of cooling of the refrigerant in the low-pressure-side heat exchanger;

a control part to control the refrigerating cycle, based on each detection value detected by each temperature detection part; and a calculation comparison part to calculate and compare a measured value and a theoretical value concerning an amount of a liquid phase part of the refrigerant in the high-pressure-side heat exchanger calculated based on the each detection value detected by the each temperature detection part.

It is a feature of the air conditioning apparatus according to the present invention that it includes:

a refrigerating cycle to connect a compressor, a high-pressure-side heat exchanger, a throttle device and a low-pressure-side heat exchanger by piping, to circulate a refrigerant of high temperature and high pressure in the high-pressure-side heat exchanger, and to circulate a refrigerant of low temperature and low pressure in the low-pressure-side heat exchanger;

a fluid sending part to make a fluid circulate outside of the high-pressure-side heat exchanger in order to perform a heat exchange between the refrigerant in the high-pressure-side heat exchanger and the fluid;

a temperature detection part of high-pressure refrigerant to detect a temperature in condensing or in middle of cooling of the refrigerant in the high-pressure-side heat exchanger;

a temperature detection part of high-pressure-side heat exchanger entrance-side refrigerant to detect a temperature of the refrigerant at an entrance side of the high-pressure-side heat exchanger;

a temperature detection part of high-pressure-side heat exchanger exit-side refrigerant to detect a temperature of the refrigerant at an exit side of the high-pressure-side heat exchanger;

a fluid temperature detection part to detect a temperature at a location of the fluid circulating outside of the high-pressure-side heat exchanger;

a temperature detection part of low-pressure refrigerant to detect a temperature in evaporating or in middle of cooling of the refrigerant in the low-pressure-side heat exchanger;

a temperature detection part of low-pressure-side heat exchanger exit-side refrigerant to detect a temperature of the refrigerant at an exit side of the low-pressure-side heat exchanger;

a control part to control the refrigerating cycle, based on each detection value detected by each temperature detection part; and a calculation comparison part to calculate a measured value and a theoretical value concerning an amount of a liquid phase part of the refrigerant in the high-pressure-side heat exchanger obtained based on the each detection value detected by the each temperature detection part.

It is a feature of the air conditioning apparatus according to the present invention that, when performing a diagnostic operation of the air conditioning apparatus, the control part controls a rotation number of the fluid sending part to make a temperature difference between the temperature of the refrigerant detected by the temperature detection part of high-pressure refrigerant and the temperature of the fluid detected by the fluid temperature detection part be close to a predetermined value.

It is a feature of the air conditioning apparatus according to the present invention that, when performing a diagnostic operation of the air conditioning apparatus, the control part controls a frequency of the compressor to make a temperature difference between the temperature of the refrigerant detected by the temperature detection part of high-pressure refrigerant and the temperature of the fluid detected by the fluid temperature detection part be close to a predetermined value.

It is a feature of the air conditioning apparatus according to the present invention that, when performing a diagnostic operation of the air conditioning apparatus, the control part controls a degree of opening of the throttle device to make the temperature of the refrigerant detected by the temperature detection part of low-pressure refrigerant be close to a predetermined value.

It is a feature of the air conditioning apparatus according to the present invention that, when performing a diagnostic operation of the air conditioning apparatus, the control part calculates a degree of superheat of the low-pressure-side heat exchanger, based on a temperature of the refrigerant detected by the temperature detection part of low-pressure refrigerant, and controls a degree of opening of the throttle device so that the degree of superheat can be close to a predetermined value.

It is a feature of the air conditioning apparatus according to the present invention that it includes a judgment part to compare measured values concerning the amount of the liquid phase part of the refrigerant in the high-pressure-side heat exchanger calculated in past and at present, and to judge a refrigerant leak, based on a change of the measured values.

It is a feature of the air conditioning apparatus according to the present invention that it includes a judgment part to compare measured values concerning the amount of the liquid phase part of the refrigerant in the high-pressure-side heat exchanger calculated in past and at present, and to judge a blockage in the refrigerating cycle or abnormality of an opening degree of the throttle device, based on a change of the measured values.

It is a feature of the air conditioning apparatus according to the present invention that it includes:

a refrigerating cycle to connect a compressor, a high-pressure-side heat exchanger, a throttle device and a low-pressure-side heat exchanger by piping, to circulate a refrigerant of high temperature and high pressure in the high-pressure-side heat exchanger, and to circulate a refrigerant of low temperature and low pressure in the low-pressure-side heat exchanger;

a fluid sending part to make a fluid circulate outside of the high-pressure-side heat exchanger in order to perform a heat exchange between the refrigerant in the high-pressure-side heat exchanger and the fluid;

a temperature detection part of high-pressure refrigerant to detect a temperature in condensing or in middle of cooling of the refrigerant in the high-pressure-side heat exchanger;

a temperature detection part of high-pressure-side heat exchanger entrance-side refrigerant to detect a temperature of the refrigerant at an entrance side of the high-pressure-side heat exchanger;

a temperature detection part of high-pressure-side heat exchanger exit-side refrigerant to detect a temperature of the refrigerant at an exit side of the high-pressure-side heat exchanger;

a fluid temperature detection part to detect a temperature at a location of the fluid circulating outside of the high-pressure-side heat exchanger;

a temperature detection part of low-pressure refrigerant to detect a temperature in evaporating or in middle of cooling of the refrigerant in the low-pressure-side heat exchanger; and a control part to control the refrigerating cycle, based on each detection value detected by each temperature detection part, wherein the throttle device includes an upstream side throttle device, a receiver, and a downstream side throttle device, and the control part performs a special operation mode that the control part moves a surplus refrigerant in the receiver into the high-pressure-side heat exchanger by making the refrigerant at an exit of the receiver be a two-phase state by way of making an opening area of the upstream side throttle device be smaller than an opening area of the downstream side throttle device.

It is a feature of the air conditioning apparatus according to the present invention that it includes:

a refrigerating cycle to connect a compressor, a high-pressure-side heat exchanger, a throttle device and a low-pressure-side heat exchanger by piping, to circulate a refrigerant of high temperature and high pressure in the high-pressure-side heat exchanger, and to circulate a refrigerant of low temperature and low pressure in the low-pressure-side heat exchanger;

a fluid sending part to make a fluid circulate outside of the high-pressure-side heat exchanger in order to perform a heat exchange between the refrigerant in the high-pressure-side heat exchanger and the fluid;

a temperature detection part of high-pressure refrigerant to detect a temperature in condensing or in middle of cooling of the refrigerant in the high-pressure-side heat exchanger;

a temperature detection part of high-pressure-side heat exchanger entrance-side refrigerant to detect a temperature of the refrigerant at an entrance side of the high-pressure-side heat exchanger;

a temperature detection part of high-pressure-side heat exchanger exit-side refrigerant to detect a temperature of the refrigerant at an exit side of the high-pressure-side heat exchanger;

a fluid temperature detection part to detect a temperature at a location of the fluid circulating outside of the high-pressure-side heat exchanger;

a temperature detection part of low-pressure refrigerant to detect a temperature in evaporating or in middle of cooling of the refrigerant in the low-pressure-side heat exchanger;

a control part to control the refrigerating cycle, based on each detection value detected by each temperature detection part; and an accumulator provided between the low-pressure-side heat exchanger and the compressor, wherein the control part performs a special operation mode that the control part moves a surplus refrigerant in the accumulator into the high-pressure-side heat exchanger by making the refrigerant flowing into the accumulator be a gas refrigerant by way of controlling the throttle device.

It is a feature of the air conditioning apparatus according to the present invention that the air conditioning apparatus includes a timer inside and the control part has a function of going to the special operation mode every specific time period by the timer.

It is a feature of the air conditioning apparatus according to the present invention that the control part has a function of going to the special operation mode by an operation signal from outside by wired or wireless.

It is a feature of the air conditioning apparatus according to the present invention that a refrigerant of $CO_2$ is used.

Effects of the Invention

By dint of the above-mentioned structure, the air conditioning apparatus according to the present invention can exactly and accurately judge normality or abnormality of the air conditioning apparatus, and perform judgment of a refrigerant leak, judgment of abnormality of operation parts, and early detection of a blockage in the piping, under any installation conditions and environmental conditions. Accordingly, it is possible to provide the air conditioning apparatus with high reliability.

BEST MODE FOR CARRYING OUT THE INVENTION

Embodiment 1

FIGS. 1 to 6 show Embodiment 1, FIG. 1 illustrates a structure of an air conditioning apparatus, FIG. 2 is a p-h diagram at the time of refrigerant leak, FIG. 3 shows a relation between $SC/dT_c$ and $NTU_R$, FIG. 4 shows a relation between $SC/dT_c$ and $NTU_R$ at the time of refrigerant leak, FIG. 5 is an operation flowchart, and FIG. 6 illustrates a calculation method of SC at a supercritical point.

As shown in FIG. 1, there are provided an outdoor unit, an indoor unit, and a refrigerating cycle 20. The outdoor unit includes a compressor 1, a four-way valve 2 which is switched from/to the state of cooling operation described as the solid line and the state of heating operation described as the broken line, an outdoor heat exchanger 3 which functions as a high-pressure-side heat exchanger (condenser) at cooling operation time and as a low-pressure-side heat exchanger (evaporator) at a heating operation time, an outdoor fan 4 which supplies air, being an example of fluid, to the outdoor heat exchanger 3, as a fluid sending part, and a throttle device 5*a* which makes a high temperature and high pressure liquid condensed by the condenser expand to be a low temperature and low-pressure refrigerant.

The indoor unit includes an indoor heat exchanger 7 which functions as a low-pressure-side heat exchanger (evaporator)

at cooling operation time and as a high-pressure-side heat exchanger (condenser) at heating operation time, and an indoor fan 8 which supplies air to the indoor heat exchanger 7, as a fluid detecting part.

The refrigerating cycle 20 includes a connection piping 6 and a connection piping 9 which connect the indoor unit and the outdoor unit, and has a heat pump function capable of supplying heat obtained by a heat exchange with outdoor air, to the inside of a room.

In the condenser of the above air conditioning apparatus, an object of endotherming of condensation heat of the refrigerant is air. However, water, refrigerant, brine, etc. can also be the object of endotherming, and a pump etc. can also be a device for supplying the object of endotherming.

In the refrigerating cycle 20, a compressor exit temperature sensor 201 (a temperature detection part of high-pressure-side heat exchanger entrance-side refrigerant) for detecting a temperature at the discharge side of the compressor 1 is installed. In order to detect a condensation temperature of the outdoor heat exchanger 3 at cooling operation time, an outdoor unit two-phase temperature sensor 202 (a temperature detection part of high-pressure refrigerant, at cooling operation time, and a temperature detection part of low-pressure refrigerant, at heating operation time) is installed. In order to detect a refrigerant exit temperature of the outdoor heat exchanger 3, an outdoor heat exchanger exit temperature sensor 204 (a temperature detection part of high-pressure-side heat exchanger exit-side refrigerant, at cooling operation time) is installed. These temperature sensors are installed to touch or to be inserted into the refrigerant piping so as to detect a refrigerant temperature. An ambient temperature outside a room is detected by an outdoor temperature sensor 203 (a fluid temperature detection part).

An indoor heat exchanger entrance temperature sensor 205 (a temperature detection part of high-pressure-side heat exchanger exit-side refrigerant, at heating operation time) is installed at the refrigerant entrance side of the indoor heat exchanger 7 at cooling operation time, and an indoor unit two-phase temperature sensor 207 (a temperature detection part of low-pressure refrigerant, at cooling operation time, and a temperature detection part of high-pressure refrigerant, at heating operation time) is installed in order to detect an evaporation temperature at cooling operation time. They are placed by the same method as the outdoor unit two-phase temperature sensor 202 and outdoor heat exchanger exit temperature sensor 204. An ambient temperature inside a room is detected by an indoor unit suction temperature sensor 206 (a fluid temperature detection part).

Each amount detected by the temperature sensor is input into a measurement part 101 and processed by a calculation part 102. A control part 103 is provided to control the compressor 1, the four-way valve 2, the outdoor fan 4, the throttle device 5*a*, and the indoor fan 8 to be in a desired control target range, based on a result of the calculation part 102. There are provided a storing part 104 to store a result obtained by the calculation part 102, a comparison part 105 to compare the stored result with a value of the present state of the refrigerating cycle, a judgment part 106 to judge normality or abnormality of the air conditioning apparatus, based on the compared result, and an informing part 107 to inform an LED (light emitting diode), a monitor in a distance, etc. of the judged result. A calculation comparison part 108 is composed of the calculation part 102, the storing part 104, and the comparison part 105.

Next, abnormality judging algorithms for a refrigerant leak by the calculation comparison part 108 and the judgment 106 in normality/abnormality judgment of the air conditioning apparatus will be explained.

FIG. 2 shows a refrigerating cycle change illustrated on a p-h diagram, in the case air conditions, the compressor frequency, the opening degree of the throttle device, and control amounts of the outdoor fan and the indoor fan are fixed and only the amount of enclosed refrigerant is reduced, in the same system structure. Since the density of refrigerant becomes high in proportion as the pressure becomes high in a liquid phase state, the enclosed refrigerant exists most at the part of the condenser. Since the volume of liquid refrigerant in the condenser decreases when the amount of refrigerant decreases, it is clear that there is a large correlation between a supercooling degree (SC) of liquid phase of the condenser and an amount of refrigerant.

When it is solved with respect to a liquid phase region of the condenser, based on a relational expression (Non-Patenting Document 1) of heat balance of the heat exchanger, a non-dimensional formula (1) can be derived.

$$SC/dT_c=1-EXP(-NTU_R) \quad (1)$$

The relation of the formula (1) is shown in FIG. 3. SC herein is a value obtained by subtracting a condenser exit temperature (a detection value of the outdoor heat exchanger exit temperature sensor 204) from a condensation temperature (a detection value of the outdoor unit two-phase temperature sensor 202). $dT_c$ is a value obtained by subtracting an outdoor temperature (a detection value of the outdoor temperature sensor 203) from a condensation temperature.

Since the left side of the formula (1) expresses temperature efficiency of a liquid phase part, this is defined as liquid phase temperature efficiency $\epsilon_L$ shown in formula (2).

$$\epsilon_L=SC/dT_c \quad (2)$$

$NTU_R$ in the right side of the formula (1) is a transfer unit number at the refrigerant side, and can be expressed as formula (3).

$$NTU_R=(K_c\times A_L)/(G_r\times C_{pr}) \quad (3)$$

where $K_c$ denotes an overall heat transfer coefficient [J/s·m$^2$·K] of the heat exchanger, $A_L$ denotes a heating surface area [m$^2$] of liquid phase, $G_r$ denotes a mass flow rate [kg/s] of refrigerant, and $C_{pr}$ denotes a specific heat at constant pressure [J/kg·K] of refrigerant.

In the formula (3), the overall heat transfer coefficient $K_c$ and the heating surface area of liquid phase $A_L$ are included. However, the overall heat transfer coefficient $K_c$ is an uncertain element because it changes by an influence of the wind, aged deterioration of a fin of the heat exchanger, etc., and the liquid phase heating surface area $A_L$ is a value which differs depending upon a specification of the heat exchanger and a state of the refrigerating cycle.

Next, an approximate heat balance formula of the whole condenser at the air side and the refrigerant side can be expressed as formula (4).

$$Kc\times A\times dT_c=G_r\times\Delta H_{CON} \quad (4)$$

where A denotes a heating surface area [m$^2$] of the condenser, and $\Delta H_{CON}$ is an enthalpy difference between the entrance and the exit of the condenser. Enthalpy at the entrance of the condenser can be calculated from a compressor exit temperature and a condensation temperature.

When arranging the formulas (3) and (4) by eliminating $K_c$ from them, it becomes formula (5). That is, it becomes possible to express $NTU_R$ as a form not containing the factors depending upon the wind and aged deterioration of a fin.

$$NTU_R=(\Delta H_{CON}\times A_L)/(dTc\times C_{pr}\times A) \quad (5)$$

Here, what is obtained by dividing the heating surface area $A_L$ of the liquid phase by the heating surface area A of the condenser is defined by formula (6).

$$A_L/A=A_L\% \quad (6)$$

When $A_L$ % is calculated, it becomes possible to compute $NTU_R$ from the formula (5) by using temperature information. Moreover, a liquid phase area ratio $A_L$ % of the condenser can be expressed by formula (7).

$$A_L\% = V_{L_CON} / V_{CON} = M_{L_CON} / (V_{CON} \cdot \rho_{L_CON}) \quad (7)$$

where the Sign V denotes a volume [$m^3$], M denotes a mass [kg] of refrigerant, and ρ denotes a density [$kg/m^3$]. The subscript L denotes a liquid phase and CON denotes a condenser.

When applying the law of mass conservation of refrigerating cycle to the formula (7) and transforming $M_{L_CON}$, it can be expressed by formula (8).

$$A_L\% = (M_{CYC} - M_{S_CON} - M_{G_CON} - M_{S_PIPE} - M_{G_PIPE} - M_{EVA}) / (V_{CON} \cdot \rho_{L_CON}) \quad (8)$$

where the subscript CYC denotes a whole refrigerating cycle, G denotes a vapor phase, S denotes a two phase, PIPE denotes a connection piping, and EVA denotes an evaporator. Furthermore, when transforming the formula (8), it can be expressed by formula (9).

$$A_L\% = ((M_{CYC} - M_{G_CON} - M_{G_PIPE} - M_{EVA}) - V_{S_CON} \cdot \rho_{S_CON} - V_{S_PIPE} \cdot \rho_{S_EVAin} - V_{S_EVA} \cdot \rho_{S_EVA}) / (V_{CON} \cdot \rho_{L_CON}) \quad (9)$$

where the subscript EVAin denotes an evaporator entrance.

Various correlation equations are proposed to calculate average densities of $\rho_{S_CON}$, and $\rho_{S_EVA}$ of a biphasic region expressed by the formula (9). According to the correlation equation of CISE (Non-Patent Document 2), when a saturation temperature is fixed, it is almost proportional to the mass flow rate $G_r$, and when the mass flow rate $G_r$ is fixed, it is almost proportional to the saturation temperature. Therefore, it can be approximated by formula (10).

$$\rho_S = A \cdot T_s + B \cdot G_r + C \quad (10)$$

where the signs A, B, and C are constants, and Ts denotes a saturation temperature.

Similarly, the density $\rho_{S_EVAin}$ of a local part of biphasic region expressed by the formula (9) can be approximated by formula (11).

$$\rho_{S_EVAin} = A' \cdot T_e + B' \cdot G_r + C' \cdot x_{EVAin} + D' \quad (11)$$

where signs A', B', C' and D' are constants, Te denotes an evaporation temperature, and $x_{EVAin}$ denotes dryness of the entrance of the evaporator.

When substituting the conditions that an enclosed refrigerant amount $M_{CYC}$ is fixed, a refrigerant amount of vapor phase is an amount which can be almost disregarded, and volumes of the heat exchanger and the connection piping are fixed for the formula (9) to arrange, and also substituting the formulas (10) and (11) for the formula (9) to arrange, it can be expressed by formula (12).

$$A_L\% = (a \cdot T_C + b \cdot G_r + c \cdot x_{EVAin} + d \cdot T_e + e) / \rho_{L_CON} \quad (12)$$

where signs a, b, c, d, and e are constants.

a, b, c, d, and e are constants which are determined by specifications of the air conditioning apparatus, such as an amount of enclosed refrigerant, a volume of a heat exchanger, and a volume of connection piping length. When calculating $A_L$ % by the formula (12), substituting the calculated $A_L$ for the formula (5) to obtain $NTU_R$, and substituting the obtained $NTU_R$ for the formula (1), a theoretical value of the liquid phase temperature efficiency $\epsilon_L$ at the time can be obtained. Since a value of $\epsilon_L$ is computable from temperature sensor information, when the amount of refrigerant in the refrigerating cycle is fixed, the value becomes almost equivalent to a value calculated from the relational expression (1). When the amount of refrigerant decreases against the initial enclosed refrigerant amount because of a refrigerant leak, since the supercooling degree SC becomes small as shown in FIG. 4, the value of $\epsilon_L$ to $NTU_R$ becomes small. Accordingly, it becomes possible to judge a leak of refrigerant.

Moreover, since a, b, c, d, and e of the formula (12) are constants determined by installation conditions, such as a length of connection piping of the air conditioning apparatus and a height difference between an indoor unit and an outdoor unit, and an initial enclosed refrigerant amount, an initial study operation is performed after installation or at the time of a test run in order to determine the above five unknown quantities and to store them in the storing part 104.

In the case of specifications and the amount of enclosed refrigerant of the air conditioning apparatus being known, it is acceptable to obtain them beforehand by performing an examination or a cycle simulation in advance, and to store them in the storing part 104.

Moreover, the unknown quantities a, b, c, d, and e in the formula (12) become constants by controlling variables, such as $T_c$ and $T_e$ in the formula, which can be controlled by making at least one of the operation frequency of the compressor, the throttle device, the outdoor fan, and the indoor fan be constant to a desired target value or be proportional according to environmental conditions, such as an outside air temperature and an indoor air temperature. Thus, by dint of performing control as the above, the number of unknown quantities is reduced, and initial study operation conditions or calculation conditions by the simulation, for deriving a formula of $A_L$ % can be reduced. Therefore, it becomes possible to reduce the time for determining unknown quantities.

Next, it will explain the flow chart of FIG. 5 where the detection algorithm of refrigerant leak is applied to the air conditioning apparatus.

In FIG. 5, a diagnostic operation of the air conditioning apparatus is performed at ST1. The operation for diagnosis can be performed by operation signals from the outside by wired or wireless, or it can be automatically performed after a lapse of time set in advance. With respect to the operation for diagnosis, when the opening degree of the throttle device 5*a* is fixed, at cooling operation time, the control part 103 controls a rotation number of the outdoor fan 4 so that a high pressure of the refrigerating cycle can be within a prescribed range of a predetermined control target value, and controls a rotation number of the compressor 1 so that a low pressure of the refrigerating cycle can be within a prescribed range of a predetermined control target value in order to have a degree of superheat at the exit of the evaporator.

At heating operation time, the control part 103 controls a rotation number of the compressor 1 so that a high pressure of the refrigerating cycle can be within a prescribed range of a predetermined control target value, and controls a rotation number of the outdoor fan 4 so that a low pressure of the refrigerating cycle can be within a prescribed range of a predetermined control target value in order to have a degree of superheat at the exit of the evaporator.

With respect to the rotation number of the compressor 1, it can be a fixed rotation number, and in this case, the control part 103 controls a degree of opening of the throttle device 5*a* so that a low pressure of the refrigerating cycle can be within a prescribed range of a predetermined control target value.

The rotation number of the indoor fan 8 can be an arbitrary number, and since the larger the rotation number is, the easier it has a degree of superheat at the evaporator at cooling operation time, and it has a degree of supercooling at the condenser at heating operation time, incorrect detection of a refrigerant leak can be prevented.

Next, at ST2, stability judgment is performed to judge whether the state of the cycle is controlled to be a desired control target value. If the state of the cycle is stable, the control part 103 discerns at ST3 whether an initial study has been performed or not. If the initial study operation has not been carried out yet, it goes to the control part to execute the initial study operation, and characteristic data of the operation is processed and stored by the control part 103 at ST6.

The initial study operation herein is an operation for removing influences of installation conditions, such as a length of connection piping of the air conditioning apparatus and a height difference between the indoor unit and the outdoor unit, or the amount of initial enclosed refrigerant. The operation state is changed by the number of unknown quantities after installation or at the time of a test run, and a prediction relation of a liquid phase area ratio $A_L$ % is formed by the calculation part 102 and the storing part 104.

In ST3, if the initial study has already been executed, normality or abnormality of the air conditioning apparatus is judged by comparing the present operation state with characteristics stored at the initial study operation at ST7, and an abnormal part or an abnormal state level of the air conditioning apparatus is output and displayed in an LED etc. of the informing part 107 at ST8.

When the initial study has already been executed, by substituting temperature information obtained by the measurement part 101 for the formula (12), a prediction value of liquid phase area ratio $A_L$ % can be computed, and the value of $NTU_R$ can be calculated by the formula (5). In this case, since the relation of the formula (1) is always formed among $NTU_R$, SC, and $dT_c$, the value of $\epsilon_L$ can be obtained. As SC and $dT_c$ can be calculated from temperature sensor information, when the value of $\epsilon_L$ $(SC/dT_c)$ computed from the temperature information and the value of $\epsilon_L(1-EXP(-NTU_R))$ are almost equal, it is judged to be normal.

An example of a measured value concerning the amount of liquid phase part of the refrigerant in the high-pressure-side heat exchanger is the value of liquid phase temperature efficiency $\epsilon_L$ $(SC/dT_c)$ calculated from the temperature information, and an example of a theoretical value concerning the amount of liquid phase part of the refrigerant in the high-pressure-side heat exchanger is the value of liquid phase temperature efficiency $\epsilon_L$ $(1-EXP(-NTU_R))$ calculated from $NTU_R$.

When the amount of refrigerant decreases against the amount of initial enclosed refrigerant, since SC becomes small, the value of $\epsilon_L$ decreases for the same value of $NTU_R$ as shown in FIG. 4. Thus, whether the refrigerant leaks or not can be judged by the judgment part 106. The decreasing rate of $\epsilon_L$ to the theoretical value is output to LED, as an abnormal state level, and when a threshold given to the abnormal state level becomes less, the informing part 107 carries out sending/informing the refrigerant leak.

In the case the cycle does not become the fixed state, meaning the state of incapable of controlling to be the control target value by an actuator operation attached with the air conditioning apparatus because of a large disturbance, such as the wind and a rapid change of indoor load, when the state of the cycle is not stable at ST2, the control part 103 judges the possibility of control at ST4, and when it is uncontrollable, the abnormal part is specified at ST9, and the informing part 107 outputs the abnormal part or an abnormal state level at ST8 to be displayed.

In the case of being impossible to control to the control target value owing to an actuator failure or a blockage in the piping system of the refrigerating cycle, the operation amount and the control target value of the actuator are compared and the abnormal part and the cause are specified by the control part 103.

In addition, with respect to the saturation temperature used for the detection algorithm herein, it is acceptable to use the outdoor unit two-phase temperature sensor 202 and the indoor unit two-phase temperature sensor 207, or it is acceptable to calculate the saturation temperature from pressure information of a high-pressure detection part pressure sensor which detects pressure of the refrigerant at some location in the path of flow from the compressor 1 to the throttle device 5*a*, or a low-pressure detection part which detects pressure of the refrigerant at some location in the path of flow from the low-pressure-side heat exchanger to the compressor 1.

By dint of the above stated, it is possible to exactly and accurately diagnose normality or abnormality of the apparatus under any installation conditions and environmental conditions, and it is possible for the judgment part 106 to judge a leak of the refrigerant and abnormality of operation parts and to early detect a portion of piping blockage. Therefore, this prevents failures of the apparatus from occurring.

In the above, has been described the state in which a refrigerant becomes two-phase state in a condensation process. However, when the refrigerant in the refrigerating cycle is a high-pressure refrigerant such as $CO_2$ and changes the state by the pressure beyond a supercritical point, a saturation temperature does not exist. Then, as shown in FIG. 6, when the intersection of the enthalpy and the measured value of pressure sensor at the critical point is regarded as a saturation temperature and it is calculated from the outdoor heat exchanger exit temperature sensor 204 as SC, since the SC becomes small at the time of a refrigerant leak according to the same theory, a refrigerant leak can be judged even in the case of refrigerant whose condensation pressure exceeds the critical pressure being used.

As to the refrigerating cycle at heating operation time, since it is the same as the refrigerating cycle at cooling operation time, a refrigerant leak can be detected by performing the same operation.

Embodiment 2

Embodiment 2 will be explained with reference to a figure. The same signs are assigned to the parts being the same as those in Embodiment 1, and detailed explanation is omitted.

FIG. 7 shows Embodiment 2, and illustrates a structure of an air conditioning apparatus. In the figure, a receiver 10 that accumulates a surplus refrigerant amount being the difference of required refrigerant amounts at the cooling operation and the heating operation is provided behind the throttle device 5*a* (an upstream side throttle device), and a throttle device 5*b* (a downstream side throttle device) is added at the exit of the receiver in the structure, which is the air conditioning apparatus of the type that needs no additional refrigerant at a spot.

Since there is the portion where a liquid refrigerant stays in the refrigerating cycle, an operation (a special operation mode) for storing the surplus refrigerant in the receiver in the outdoor heat exchanger 3 is performed by the operation for controlling of throttling the opening degree of the throttle device 5*a* and slightly opening the opening degree of the throttle device 5*b*. By dint of controlling as the above, when a refrigerant leaks, the supercooling degree of the condenser changes. Therefore, even the model with a receiver, without using s peculiar detection equipment which detects a surface, it is possible to exactly and accurately diagnose normality or abnormality of the apparatus under any installation conditions and environmental conditions, and it is possible to judge a leak of the refrigerant and abnormality of operation parts and to early detect a portion of piping blockage. Therefore, this prevents failures of the apparatus from occurring.

The air conditioning apparatus is equipped with a timer (not illustrated) inside, and has a function of going into a special operation mode every specific time period by the timer. Moreover, the air conditioning apparatus has a function of going into the special operation mode by operation signals from the outside by wired or wireless.

Embodiment 3

Embodiment 3 will be explained with reference to a figure. The same signs are assigned to the parts being the same as those in Embodiment 1, and detailed explanation is omitted.

FIGS. 8 and 9 show Embodiment 3, FIG. 8 illustrates a structure of an air conditioning apparatus, and FIG. 9 illustrates another structure of the air conditioning apparatus.

As shown in FIG. 8, an accumulator 11 is provided at the suction portion of the compressor, and a surplus refrigerant amount being the difference of required refrigerant amounts at the cooling operation and the heating operation is accumulated in the accumulator 11, which is the air conditioning apparatus of the type that needs no additional refrigerant at a spot.

In the case of there being the accumulator 11, since it is necessary to perform an operation not to accumulate a liquid refrigerant in the accumulator 11, the throttle device 5*a* is throttled by the indoor heat exchanger 7 in order to have enough superheat degree (SH) at cooling operation time, and the operation in which an evaporation temperature detected by the indoor heat exchanger entrance temperature sensor 205 or the indoor unit two-phase temperature sensor 207 is made to be low is performed (a special operation mode). The air conditioning apparatus is equipped with a timer (not illustrated) inside, and has a function of going into a special operation mode every specific time period by the timer. Moreover, the air conditioning apparatus has a function of going into the special operation mode by operation signals from the outside by wired or wireless.

As shown in FIG. 9, by adding an indoor unit exit temperature sensor 208 (a temperature detection part of low-pressure-side heat exchanger exit-side refrigerant) at the exit of the indoor unit, a superheat degree of the refrigerant can be obtained by subtracting a value detected by the indoor unit two-phase temperature sensor 207 from a value detected by the indoor unit exit temperature sensor 208. When it does not have a desired superheat degree, the operation state in which SH certainly exists at the exit of the evaporator exit can be realized by further throttling the opening degree of the throttle device 5*a*. Therefore, it is possible to prevent an incorrect detection of the refrigerant leak.

As stated above, even the model with the accumulator 11, without using s peculiar detection equipment which detects a surface, it is possible to exactly and accurately diagnose normality or abnormality of the apparatus under any installation conditions and environmental conditions, and it is possible to judge a leak of the refrigerant and abnormality of operation parts and to early detect a portion of piping blockage. Therefore, this prevents failures of the apparatus from occurring.

DESCRIPTION OF THE SIGNS

Figure 1:
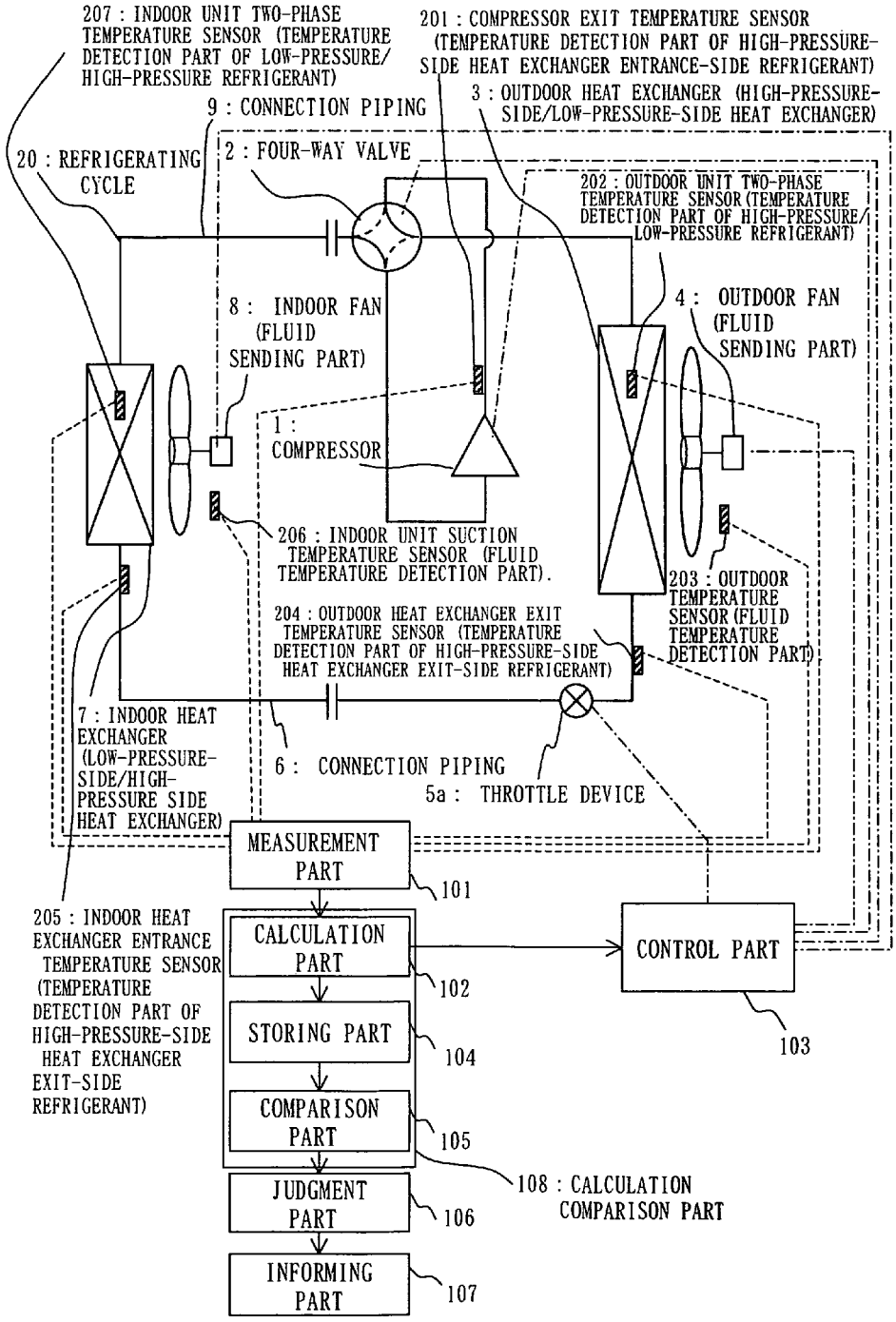
FIG. 1 shows a structure of an air conditioning apparatus according to Embodiment 1.
Figure 2:
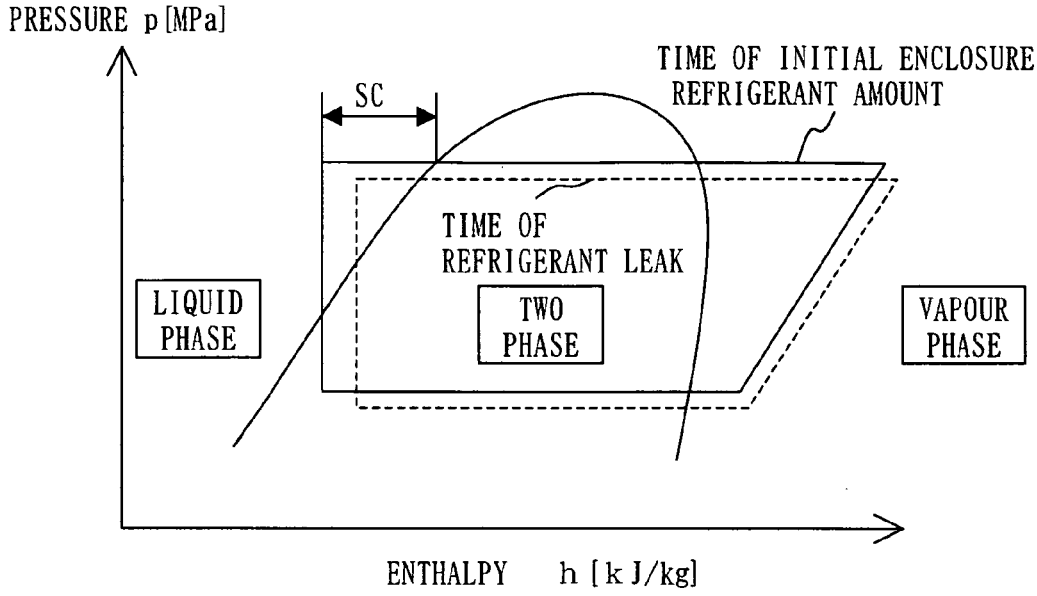
FIG. 2 shows a p-h diagram at the time of a refrigerant leak according to Embodiment 1.
Figure 3:
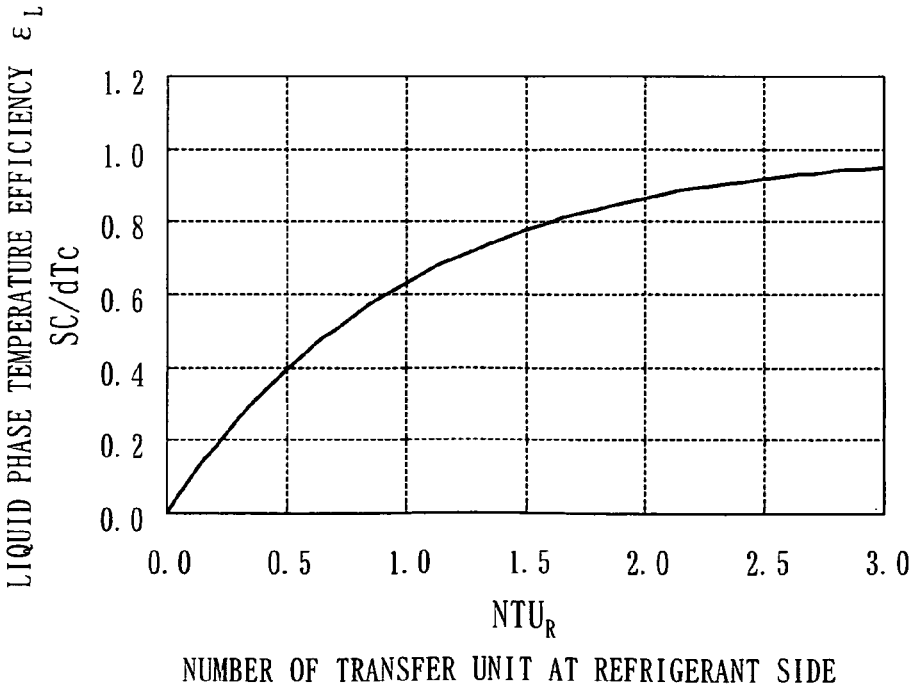
FIG. 3 shows a relation between SC/dTc and $NTU_R$ according to Embodiment 1.
Figure 4:
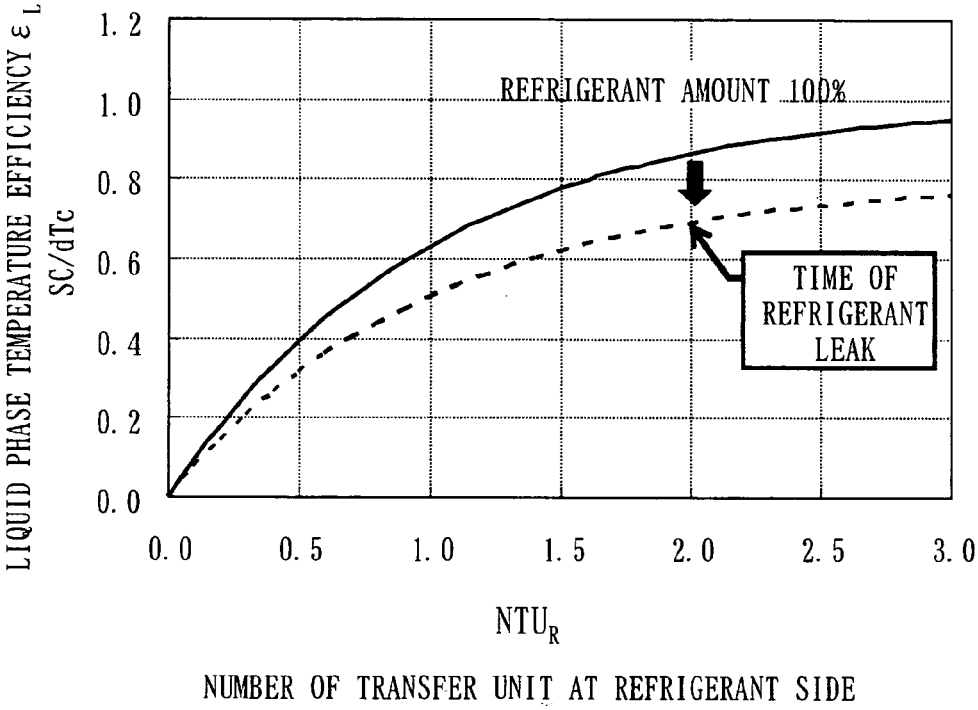
FIG. 4 shows a relation between SC/dTc and $NTU_R$ at the time of a refrigerant leak according to Embodiment 1.
Figure 5:
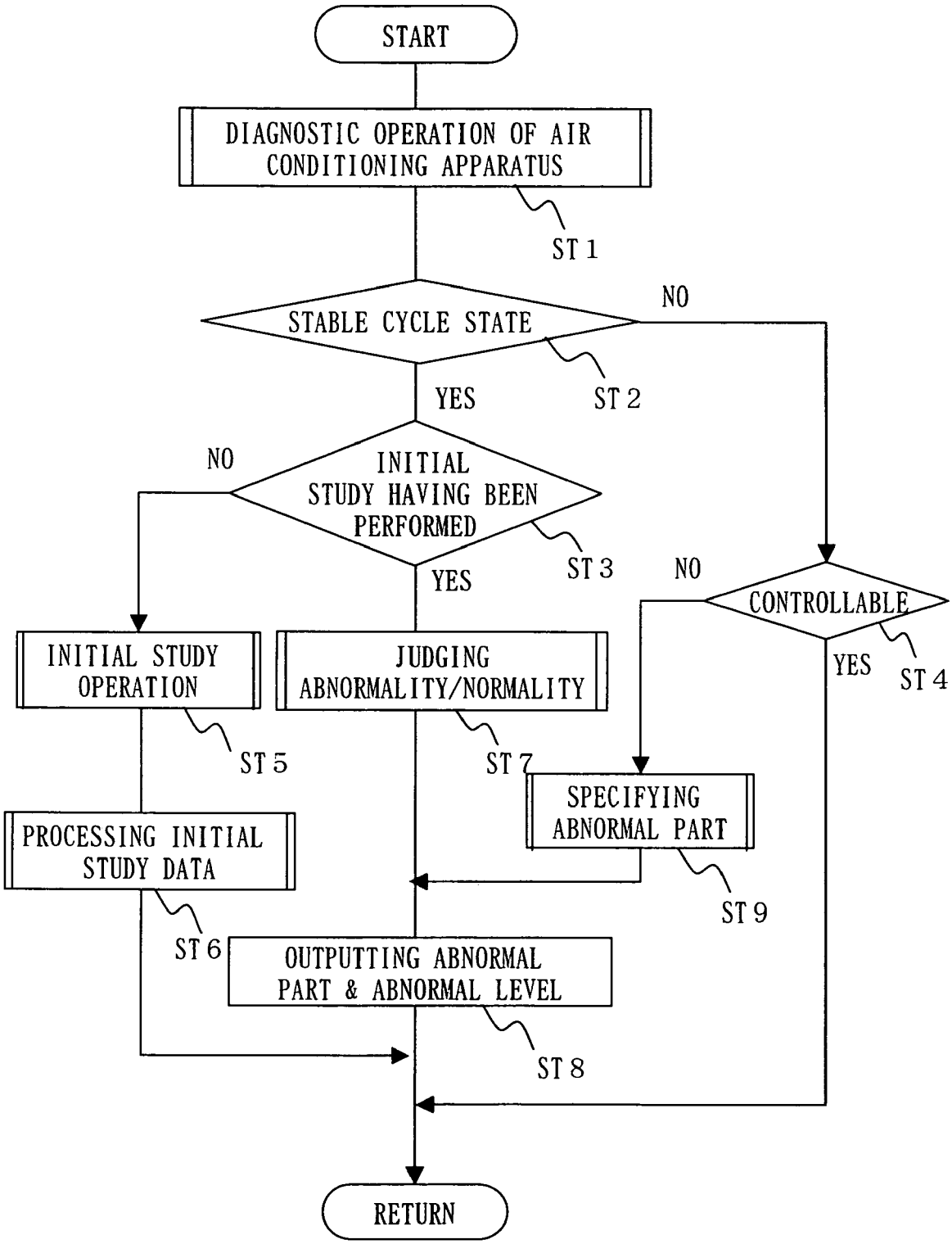
FIG. 5 shows a flowchart of an operation according to Embodiment 1.
Figure 6:
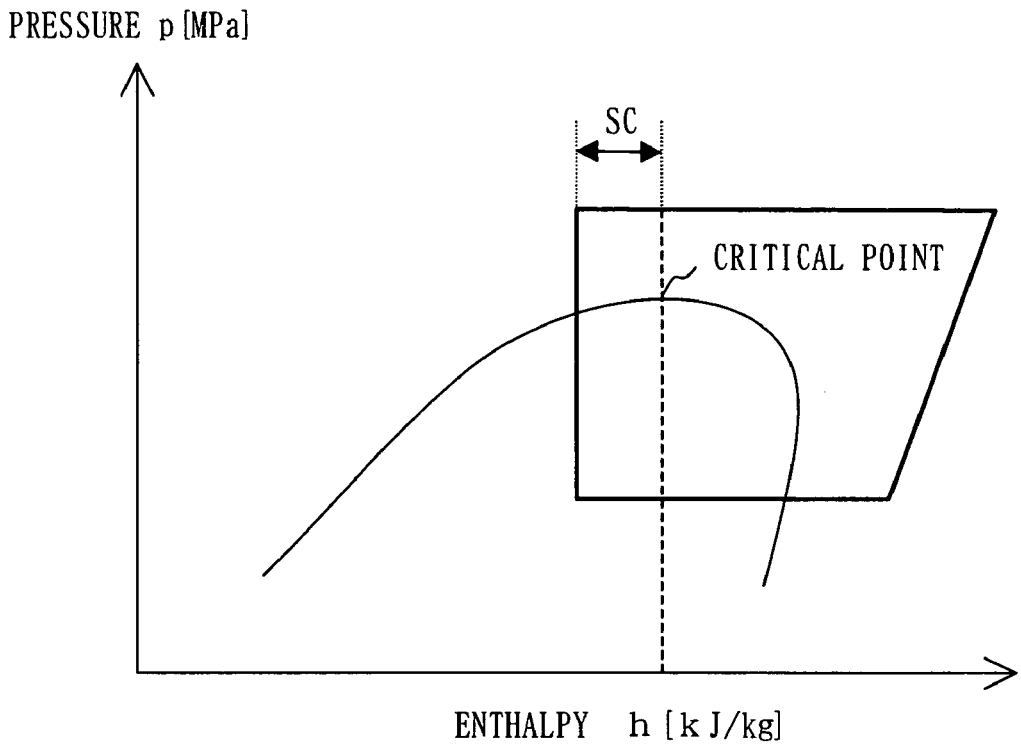
FIG. 6 shows a calculation method of SC at a supercritical point according to Embodiment 1.
Figure 7:
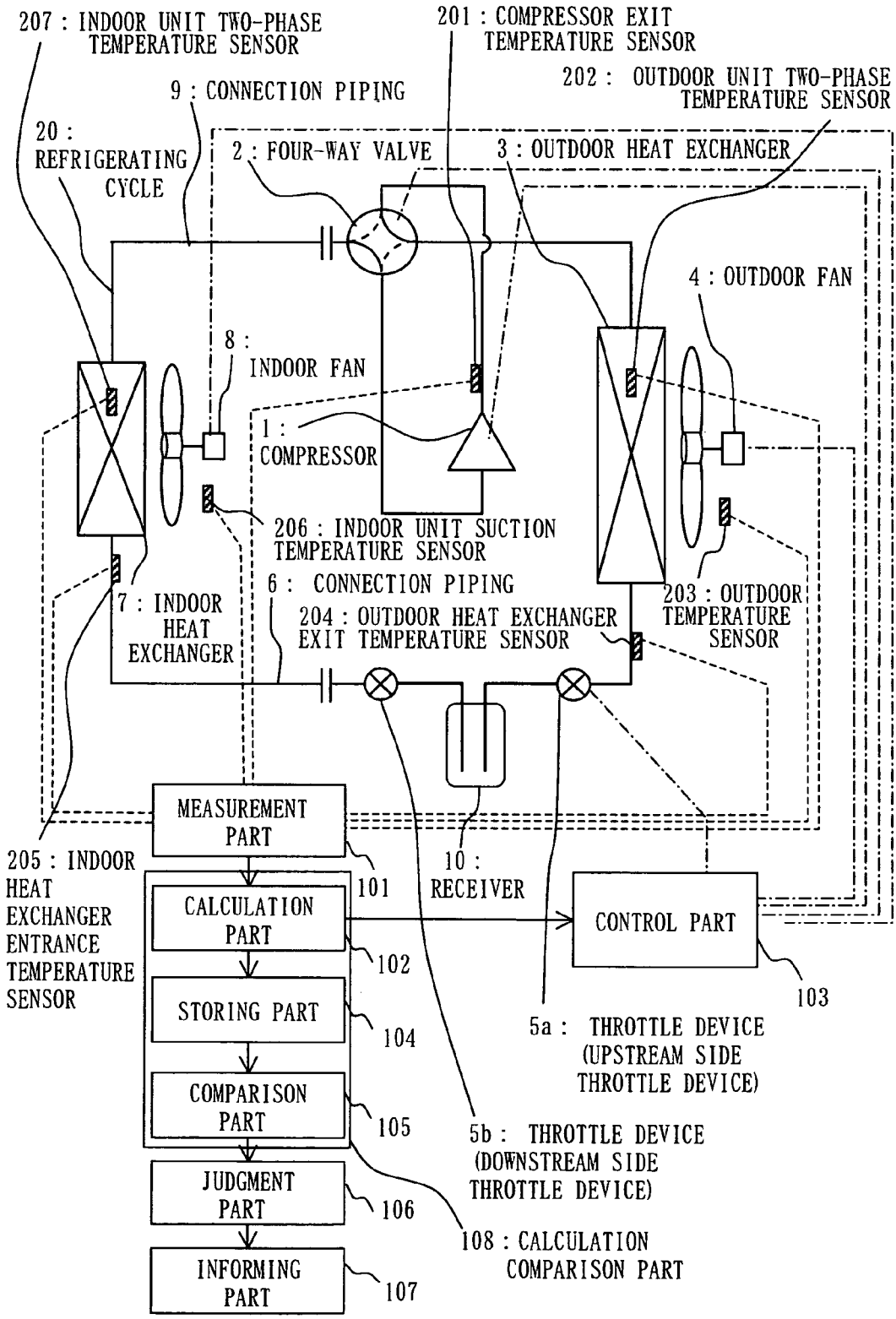
FIG. 7 shows a structure of an air conditioning apparatus according to Embodiment 2.
Figure 8:
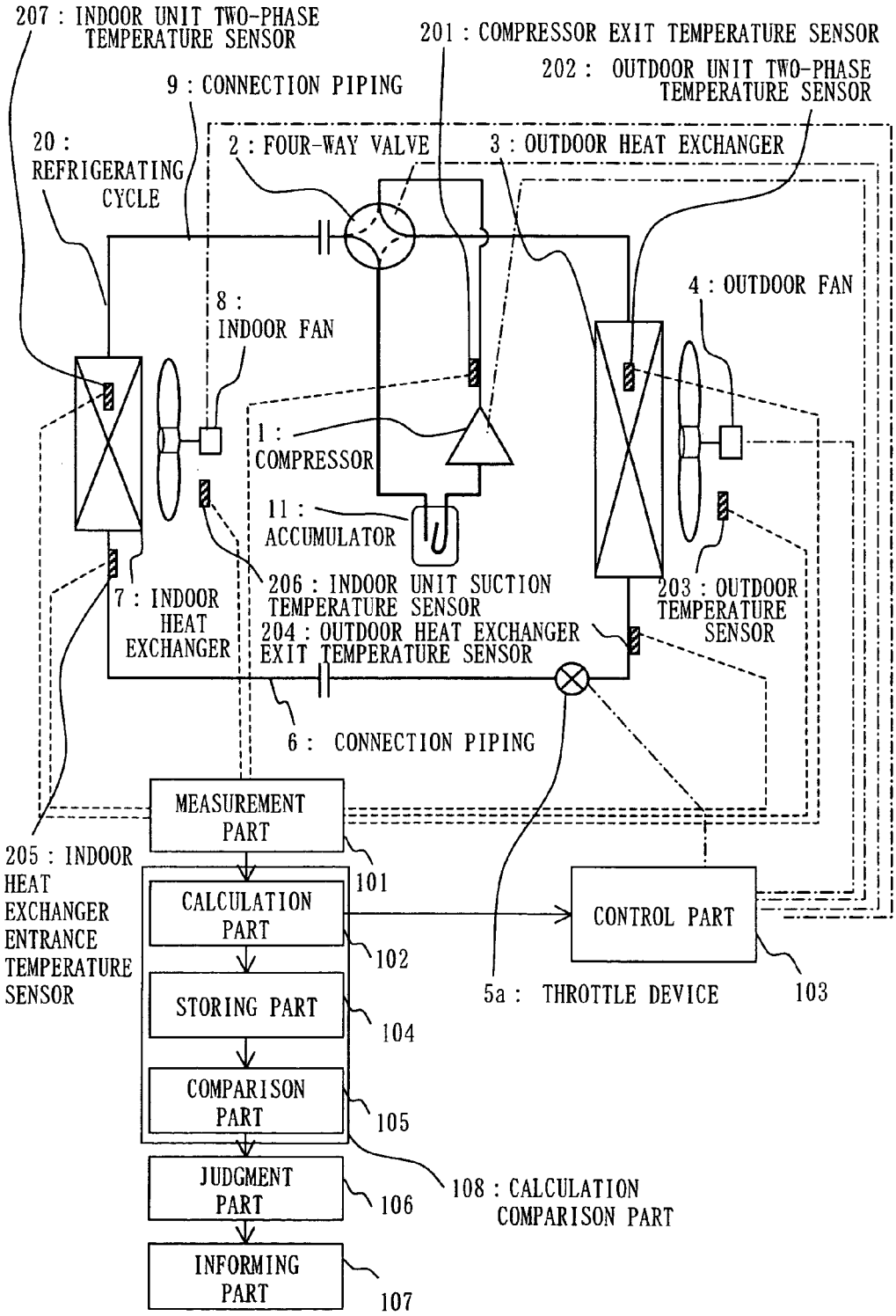
FIG. 8 shows a structure of an air conditioning apparatus according to Embodiment 3.
Figure 9:
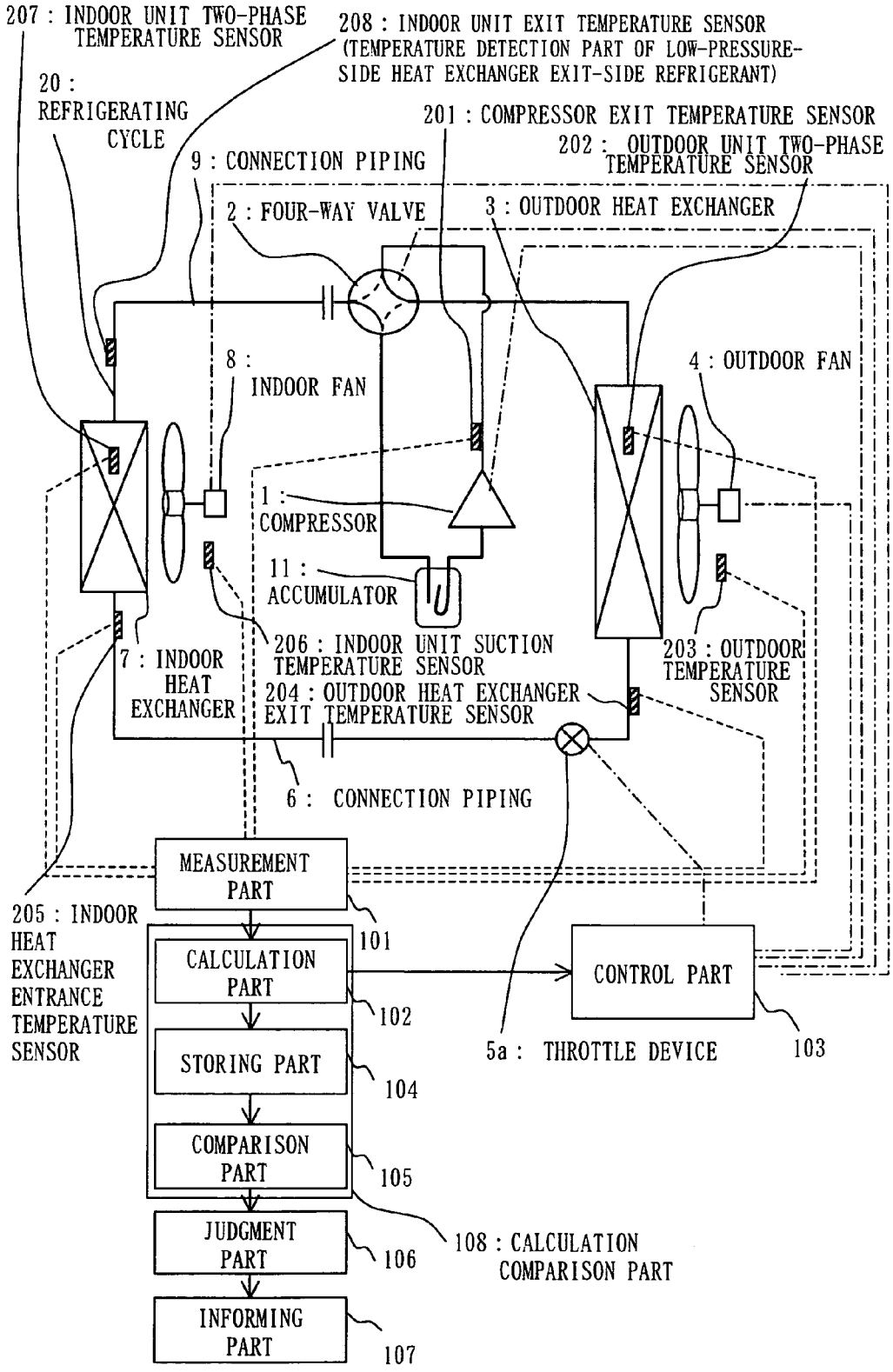
FIG. 9 shows another structure of the air conditioning apparatus according to Embodiment 3.

1 compressor, 2 four-way valve, 3 outdoor heat exchanger, 4 outdoor fan, 5*a* throttle device, 5*b* throttle device, 6 connection piping, 7 indoor heat exchanger, 8 indoor fan, 9 connection piping, 10 receiver, 11 accumulator, 20 refrigerating cycle, 201 compressor exit temperature sensor, 202 outdoor unit two-phase temperature sensor, 203 outdoor temperature sensor, 204 outdoor heat exchanger exit temperature sensor, 205 indoor heat exchanger entrance temperature sensor, 206 indoor unit suction temperature sensor, 207 indoor unit two-phase temperature sensor, 208 indoor unit exit temperature sensor, 101 measurement part, 102 calculation part, 103 control part, 104 storing part, 105 comparison part, 106 judgment part, 107 informing part, 108 calculation comparison part.

The invention claimed is:

1. An air conditioning apparatus comprising:

a refrigerating cycle to connect a compressor, a high-pressure-side heat exchanger, a throttle device and a low-pressure-side heat exchanger by piping, to circulate a refrigerant of high temperature and high pressure in the high-pressure-side heat exchanger, and to circulate a refrigerant of low temperature and low pressure in the low-pressure-side heat exchanger;

a temperature detection part of high-pressure refrigerant to detect a temperature of the refrigerant in the high-pressure-side heat exchanger;

a temperature detection part of high-pressure-side heat exchanger entrance-side refrigerant to detect a temperature of the refrigerant at an entrance side of the high-pressure-side heat exchanger;

a temperature detection part of high-pressure-side heat exchanger exit-side refrigerant to detect a temperature of the refrigerant at an exit side of the high-pressure-side heat exchanger;

a fluid temperature detection part to detect a temperature at a location of the fluid circulating outside of the high-pressure-side heat exchanger;

a calculation comparison part to calculate a first value obtained by dividing a supercooling degree SC which is obtained by subtracting the temperature detected by the temperature detection part of high-pressure-side heat exchanger exit-side refrigerant from the temperature detected by the temperature detection part of high-pressure refrigerant, by $dT_c$ which is a value obtained by subtracting the temperature detected by the fluid temperature detection part from the temperature detected by the temperature detection part of high-pressure refrigerant, and $1-EXP(-NTU_R)$ as a second value based on $NTU_R$ which is obtained by calculating $(\Delta H_{CON} \times A_L)/$ ($dT_c \times C_{pr} \times A$) (where $\Delta H_{CON}$ is an enthalpy difference between an enthalpy at the entrance of the high-pressure-side heat exchanger which is calculated from the temperature detected by the temperature detection part of high-pressure-side heat exchanger entrance-side refrigerant and the temperature detected by the temperature detection part of high-pressure refrigerant and an enthalpy at the exit of the high-pressure-side heat exchanger which is calculated from the temperature detected by the temperature detection part of high-pressure-side heat exchanger exit-side refrigerant and the temperature detected by the temperature detection part of high-pressure refrigerant, $A_L$ is a heating surface area of liquid phase of the high-temperature-side heat exchanger, A is a heating surface area of the high-temperature-side heat exchanger, and $C_{pr}$ is a specific heat at constant pressure of the refrigerant), and compare the first value calculated and the second value calculated; and a judgment part to judge a refrigerant leak based on a comparison result of the calculation comparison part.

2. The air conditioning apparatus of claim 1, further comprising a control part to execute an initial learning operation which is aimed at obtaining a value serving to calculate $A_L$ and A in $(\Delta H_{CON} \times A_L)/(dT_c \times C_{pr} \times A)$ and determined by specifications of the air conditioning apparatus and which is operated while changing setting of the refrigerating cycle;

wherein the calculation comparison part calculates $A_L$ and A based on the value obtained in the initial learning operation executed by the control part, and calculates $(\Delta H_{CON} \times A_L)/(dT_c \times C_{pr} \times A)$ based on $A_L$ calculated and A calculated.

3. The air conditioning apparatus of claim 1, further comprising:

a fluid sending part to make a fluid circulate outside of the high-pressure-side heat exchanger in order to perform a heat exchange between the refrigerant in the high-pressure-side heat exchanger and the fluid; and a control part to control operation of the fluid sending part to make a temperature difference between the temperature detected by the temperature detection part of high-pressure refrigerant and the temperature detected by the fluid temperature detection part be close to a predetermined value;

wherein the calculation comparison part calculates the first value and the second value after the control part controls, and compares the first value and second value calculated.

4. The air conditioning apparatus of claim 1, further comprising:

a control part to control a frequency of the compressor to make a temperature difference between the temperature detected by the temperature detection part of high-pressure refrigerant and the temperature detected by the fluid temperature detection part be close to a predetermined value;

wherein the calculation comparison part calculates the first value and the second value after the control part controls, and compares the first value and second value calculated.

5. The air conditioning apparatus of claim 1, further comprising:

a temperature detection part of low-pressure refrigerant to detect a temperature of the refrigerant in the low-pressure-side heat exchanger; and a control part which controls a degree of opening of the throttle device to make the temperature detected by the temperature detection part of low-pressure refrigerant be close to a predetermined value;

wherein the calculation comparison part calculates the first value and the second value after the control part controls, and compares the first value and second value calculated.

6. The air conditioning apparatus of claim 1, further comprising:

a temperature detection part of low-pressure refrigerant to detect a temperature of the refrigerant in the low-pressure-side heat exchanger;

a temperature detection part of low-pressure-side heat exchanger exit-side refrigerant to detect a temperature of the refrigerant at an exit side of the low-pressure-side heat exchanger; and a control part which controls a degree of opening of the throttle device such that a degree of superheat calculated by subtracting the temperature detected by the temperature detection part of low-pressure-side heat exchanger exit-side refrigerant from the temperature detected by the temperature detection part of low-pressure refrigerant becomes not less than a predetermined value;

wherein the calculation comparison part calculates the first value and the second value after the control part controls, and compares the first value and second value calculated.

7. The air conditioning apparatus of claim 1, wherein the throttle device includes an upstream side throttle device, a receiver, and a downstream side throttle device, the air conditioning apparatus further comprising:

a control part which performs a special operation mode that the control part moves a surplus refrigerant in the receiver into the high-pressure-side heat exchanger by making the refrigerant at an exit of the receiver be a two-phase state by way of making an opening area of the upstream side throttle device be smaller than an opening area of the downstream side throttle device; and wherein the calculation comparison part calculates the first value and the second value after the control part performs the special operation mode, and compares the first value and second value calculated.

8. The air conditioning apparatus of claim 1, further comprising:

an accumulator provided between the low-pressure-side heat exchanger and the compressor; and a control part which performs a special operation mode that the control part moves a surplus refrigerant in the accumulator into the high-pressure-side heat exchanger by making the refrigerant flowing into the accumulator be a gas refrigerant by way of controlling the throttle device;

wherein the calculation comparison part calculates the first value and the second value after the control part performs the special operation mode, and compares the first value and second value calculated.

9. The air conditioning apparatus of claim 7, further comprising:

a timer;

wherein the control part performs the special operation mode every specific time period counted by the timer.

10. The air conditioning apparatus of claim 8, further comprising:

a timer;

wherein the control part performs the special operation mode every specific time period counted by the timer.

11. The air conditioning apparatus of claim 7, wherein the control part performs the special operation mode by an operation signal from outside by wired or wireless.

12. The air conditioning apparatus of claim 8, wherein the control part performs the special operation mode by an operation signal from outside by wired or wireless.

13. An air conditioning apparatus comprising:

a refrigerating cycle to connect a compressor, a high-pressure-side heat exchanger, a throttle device and a low-pressure-side heat exchanger by piping, to circulate a refrigerant of high temperature and supercritical pressure in the high-pressure-side heat exchanger, and to circulate a refrigerant of low temperature and low pressure in the low-pressure-side heat exchanger;

a pressure detection part of high-pressure refrigerant to detect a pressure of the refrigerant in the high-pressure-side heat exchanger;

a temperature detection part of high-pressure-side heat exchanger entrance-side refrigerant to detect a temperature of the refrigerant at an entrance side of the high-pressure-side heat exchanger;

a temperature detection part of high-pressure-side heat exchanger exit-side refrigerant to detect a temperature of the refrigerant at an exit side of the high-pressure-side heat exchanger;

a fluid temperature detection part to detect a temperature at a location of the fluid circulating outside of the high-pressure-side heat exchanger;

a calculation comparison part to calculate a first value obtained by dividing SC which is a value obtained by subtracting the temperature detected by the temperature detection part of high-pressure-side heat exchanger exit-side refrigerant from an imaginary saturation temperature which is a temperature of the refrigerant in a case wherein an enthalpy of a refrigerant at the pressure detected by the pressure detection part of high-pressure refrigerant is an enthalpy at a critical point of the refrigerant, by $dT_c$ which is a value obtained by subtracting the temperature detected by the fluid temperature detection part from the imaginary saturation temperature, and $1-EXP(-NTU_R)$ as a second value based on $NTU_R$ which is obtained by calculating $(\Delta H_{CON} \times A_L)/(dT_c \times C_{pr} \times A)$ (where $\Delta H_{CON}$ is an enthalpy difference between an enthalpy at the entrance of the high-pressure-side heat exchanger which is calculated from the temperature detected by the temperature detection part of high-pressure-side heat exchanger entrance-side refrigerant and the pressure detected by the pressure detection part of high-pressure refrigerant and an enthalpy at the exit of the high-pressure-side heat exchanger which is calculated from the temperature detected by the temperature detection part of high-pressure-side heat exchanger exit-side refrigerant and the pressure detected by the pressure detection part of high-pressure refrigerant, $A_L$ is a heating surface area of liquid phase of the high-temperature-side heat exchanger, A is a heating surface area of the high-temperature-side heat exchanger, and $C_{pr}$ is a specific heat at constant pressure of the refrigerant), and compare the first value calculated and the second value calculated; and a judgment part to judge a refrigerant leak based on a comparison result of the calculation comparison part.

14. The air conditioning apparatus of claim 13, wherein a refrigerant of $CO_2$ is used.

* * * * *